US007096643B2

(12) United States Patent
Le Gallo

(10) Patent No.: US 7,096,643 B2
(45) Date of Patent: Aug. 29, 2006

(54) DEVICE FOR CLOSING ENVELOPE FLAPS

(75) Inventor: Stephane Le Gallo, Igny (FR)

(73) Assignee: Neopost Industrie, Bagneux (FR)

( * ) Notice: Subject to any disclaimer, the term of this patent is extended or adjusted under 35 U.S.C. 154(b) by 341 days.

(21) Appl. No.: 10/211,458

(22) Filed: Aug. 5, 2002

(65) Prior Publication Data

US 2002/0184852 A1 Dec. 12, 2002

Related U.S. Application Data

(62) Division of application No. 09/447,551, filed on Nov. 23, 1999, now Pat. No. 6,453,642.

(30) Foreign Application Priority Data

Nov. 24, 1998 (FR) ..... 98 14757

(51) Int. Cl.
*B65B 61/26* (2006.01)

(52) U.S. Cl. ..... 53/131.2; 53/376.3; 53/460; 493/917; 400/56; 400/636

(58) Field of Classification Search ..... 53/131.2, 53/377.2, 64, 376.3, 374.9, 460; 493/917, 493/216, 460; 270/37, 50; 400/56, 636, 400/641; 271/273
See application file for complete search history.

(56) References Cited

U.S. PATENT DOCUMENTS 1,716,936 A * 6/1929 Waterworth ..... 493/421
2,230,168 A * 1/1941 Spiess ..... 493/421
3,773,314 A * 11/1973 Giovannini ..... 493/18
4,225,128 A * 9/1980 Holyoke ..... 493/421
4,270,742 A * 6/1981 Kobayashi ..... 270/37
4,643,123 A 2/1987 Auerbach
4,763,575 A * 8/1988 Miciukiewicz ..... 101/91
4,867,058 A 9/1989 Luckhurst
4,990,003 A 2/1991 Jingu et al.
5,046,710 A * 9/1991 Vijuk ..... 270/37
5,061,095 A * 10/1991 Asai et al. ..... 400/605
5,203,263 A 4/1993 Berger et al.
5,251,425 A 10/1993 Kern
5,517,797 A 5/1996 Ballard et al.
5,809,752 A 9/1998 Holbrook
6,050,054 A 4/2000 Van Lierde et al.
6,094,894 A 8/2000 Yates

FOREIGN PATENT DOCUMENTS

FR 2742693 * 6/1997

* cited by examiner

*Primary Examiner*—Sameh H. Tawfik
(74) *Attorney, Agent, or Firm*—Sughrue Mion, PLLC

(57) ABSTRACT

A mail-handling machine including a postage-metering or "franking" module including at least a print mechanism for printing a postage imprint on a mail item and a conveyor for conveying the mail item along a mail item conveyor path defined by top and bottom guide plates. The conveyor includes at least a mail item engagement mechanism including a bottom plate mounted to move vertically at the inlet of the franking module. A support supports the mail items at the inlet of the franking module. The support is moveable in a manner synchronized with the vertical movement of the bottom engagement means.

2 Claims, 3 Drawing Sheets

DEVICE FOR CLOSING ENVELOPE FLAPS

This is a divisional of application Ser. No. 09/447,551 filed Nov. 23, 1999 now U.S. Pat. No. 6,453,642; the disclosure of which is incorporated herein by reference.

TECHNICAL FIELD

The present invention relates to the field of mail handling, and it relates more particularly to a mail-handling machine equipped with an improved device for closing envelope flaps.

PRIOR ART

Conventionally, envelope flaps are closed in a mail-handling machine by means of the pressure exerted by the engagement means at the inlet of the postage metering or "franking" module, the flaps having been previously moistened by a moistener in a feed module for feeding mail items into the machine, which module is disposed immediately upstream from the franking module.

Unfortunately, the simplicity of that envelope flap closure system gives rise to numerous drawbacks. In particular, it has been observed that even though that system does indeed close the envelope, said envelope can be sealed incorrectly, because the previously-moistened flap can be folded abnormally or even torn in part. FIGS. 3 to 5 show, in order of increasing importance, examples of defects encountered in practice (such defects generally being accentuated with increasing thickness of the envelope). In FIG. 3, the flap 10 has portions 12, 14 that are not fully closed at its top corners, or portions 16 that are not fully stuck down. That defect is accentuated in FIG. 4, in which the flap can show traces of impacts 18 from the engagement means, and the portion of the flap in one of the top corners can be rucked up and open so that a portion of the document 20 is apparent. In extreme cases, as shown in FIG. 5, if the flap is too widely open, the contact with the engagement means causes it to be crushed and a slanting fold 22 might form, causing a gummed zone 24 of the flap to be apparent and creating an adhesion zone 26 in which the flap adheres to the document contained in the envelope, which is a particularly critical defect.

Naturally, such distortion of the envelope disturbs its longitudinal alignment or "jogging" along the conveyor path, which can also give rise to defects in the printing of the postage imprint which is then not printed exactly horizontally (for example, a horizontal line then appears as a wavy line).

Unfortunately, the consequences of such defects in sealing envelopes are considerable insofar as a damaged envelope whose postage imprint is distorted might be rejected by the postal authority.

DEFINITION AND OBJECT OF THE INVENTION

An object of the present invention is to mitigate those envelope sealing defects by proposing a mail-handling machine equipped with a device that facilitates closure of envelope flaps, and that is both simple and reliable. Another object of the invention is to propose a device that can be adapted to fit existing mail-handling machines, without requiring any complex structural modification.

These objects are achieved by a mail-handling machine comprising at least firstly a postage-metering or "franking" module comprising at least print means for printing a postage imprint on a mail item and conveyor means for conveying said mail item along a mail item conveyor path defined by top and bottom guide plates, which conveyor means comprise at least mail item engagement means including bottom means mounted to move vertically, which engagement means are disposed at the inlet of the franking module, and secondly a mail item feed module disposed immediately upstream from the franking module and comprising at least conveyor means for conveying the mail items, and a moistener device, said mail-handling machine further comprising support means for supporting the mail items as they move between the feed module and the franking module, which support means are suitable for being moved in a manner synchronized with the vertical movement of the bottom engagement means.

The presence of the support means makes it possible to guide the envelope continuously while advantageously starting to close its flap which, without the deflector, would tend to open merely by gravity. In addition, impacts with the engagement means such as a roller or a belt are almost eliminated because the support means move with the bottom engagement means.

In a preferred embodiment, said support means are constituted by a deflector hinged via one of its longitudinal edges to a body or base of the franking module, the other of its two longitudinal edges resting on the bottom guide plate of the mail item conveyor path in the franking module. Advantageously, the deflector which is disposed transversely to the mail item conveyor path is clipped to a hinge pin on the body of the franking module.

In a second embodiment, the support means are constituted by a deflector hinged via one of its longitudinal edges to a body of the feed module, the other one of its two longitudinal edges resting on the bottom guide plate of the mail item conveyor path at the inlet of the franking module. Preferably, the deflector is mounted on a front edge of the moistener device.

The invention also provides a franking module for a mail-handling machine, said franking module comprising print means for printing a postage imprint on a mail item and conveyor means for conveying said mail item along a mail item conveyor path defined by top and bottom guide plates, which conveyor means comprise at least mail item engagement means including bottom means mounted to move vertically, which engagement means are disposed at the inlet of the franking module, said franking module further comprising support means for supporting the mail items at the inlet of the franking module, which support means are suitable for being moved in a manner synchronized with the vertical movement of the bottom engagement means.

Advantageously, the support means are constituted by a deflector hinged via one of its longitudinal edges to a body or base of the franking module, the other of its two longitudinal edges resting on the bottom guide plate of the mail item conveyor path. The deflector which is disposed transversely to the mail item conveyor path is clipped to a hinge pin on the body of the franking module.

BRIEF DESCRIPTION OF THE DRAWINGS

Other characteristics and advantages of the present invention appear more clearly from the following description given by way of non-limiting indication and with reference to the accompanying drawings, in which.

DETAILED DESCRIPTION OF A PREFERRED EMBODIMENT OF THE INVENTION

Figure 6:
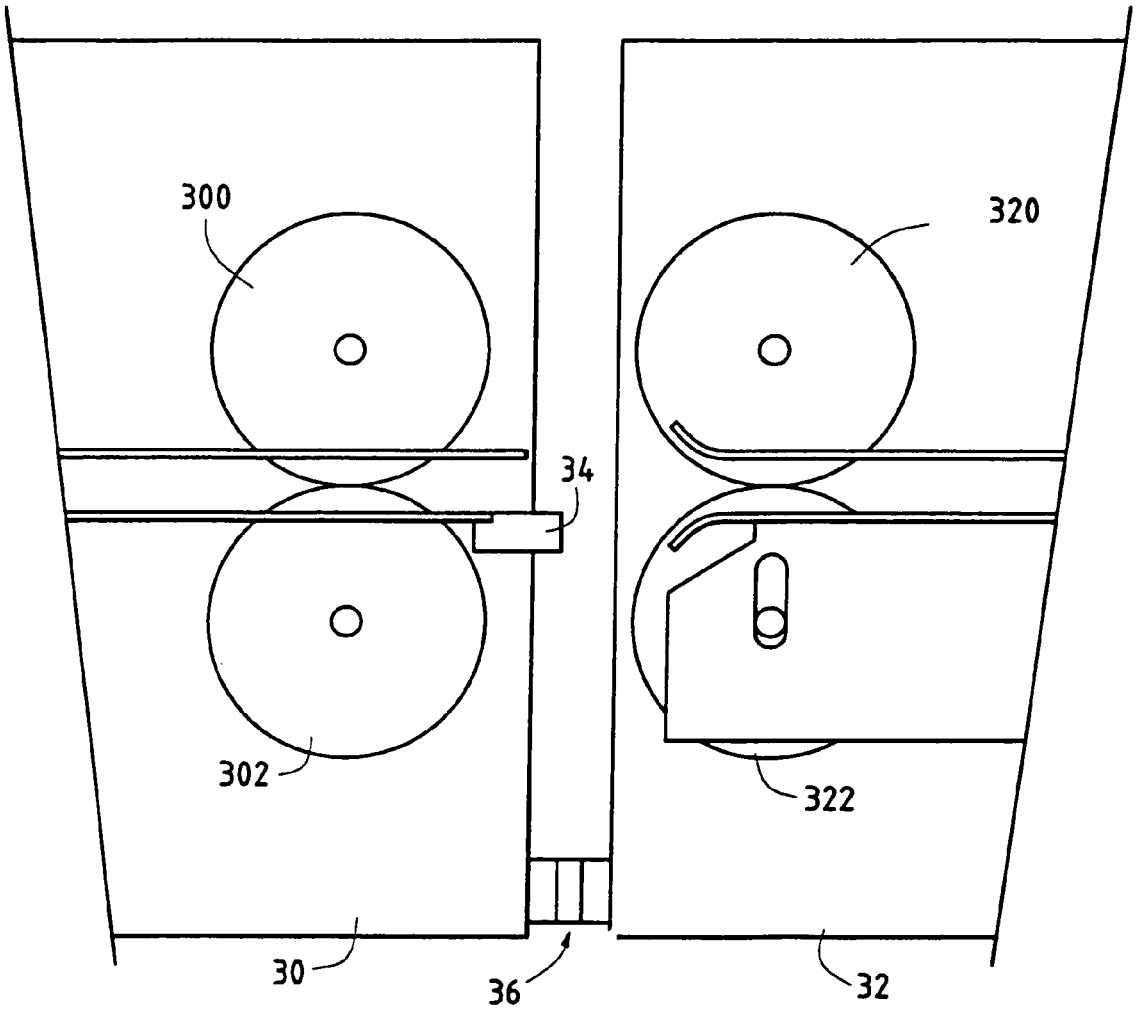
PRIOR ART FIG.6
FIG. 6 is a fragmentary view of such a conventional mail-handling machine.

FIG. 6 is a very diagrammatic view of two of the main components of a mail-handling machine. The first component is constituted by a feed module 30 for feeding in mail items, which module is equipped with conveyor means for conveying the mail items, which means are, for example, made up of two superposed drive rollers 300, 302, one of which is motor-driven. The second component is constituted by a postage metering or "franking" module 32 for franking mail items, which module is equipped with print means (not shown) and with conveyor means for conveying the mail items, which conveyor means are, in particular, made up of two superposed engagement rollers, namely a motor-driven roller 320 and a backing roller 322 mounted to move vertically, which rollers are mounted at the inlet of the franking module. In a variant embodiment, the engagement means may also be constituted merely by a belt. Conventionally, at its outlet, the feed module is provided with a moistener device 34 for moistening the flaps of the envelopes which are sealed subsequently on passing through the engagement rollers of the franking module. Connection means 36 are also provided on each of the modules so as to provide a mechanical link and continuity in the electrical links inside the mail-handling machine (these connection means define a non-zero minimum gap between the two modules).

Naturally, the mail-handling machine includes other components, be they mechanical (e.g. a selector module) or electronic (monitoring and control means). However, it is unnecessary to describe them in order to illustrate the present invention, and they are not therefore described or shown.

As mentioned above, the inventors have observed that such a conventional postage meter or "franking machine" is not without defects, in particular concerning closure of envelope flaps. After many tests, they observed that those defects are due essentially to the poor conditions under which the envelopes are engaged in the engagement rollers at the inlet of the franking module. They observed that, as it advances, the envelope is subjected to a plurality of successive micro-impacts against the bottom engagement roller of the module, which micro-impacts can cause it to be diverted out of alignment as it is guided along the conveyor path. This is made even more noticeable by the fact that, since the flap has been previously moistened, it has a natural tendency to open under gravity.

The inventors therefore conceived a device for assisting the closure of envelope flaps in a mail-handling machine, which devices is capable of eliminating, or at least limiting, the micro-impacts to which the envelope is subjected as it is conveyed from the feed module to the franking module. They also sought to improve the guiding of the envelope so that it is engaged into the franking machine under the best possible conditions, in particular without being diverted.

In the invention, means are proposed for supporting the mail items as they move between the feed module and the franking module, which support means are suitable for accompanying the bottom engagement means disposed at the inlet of the franking module as they move downwards when the mail item is of some thickness.

Figure 1:
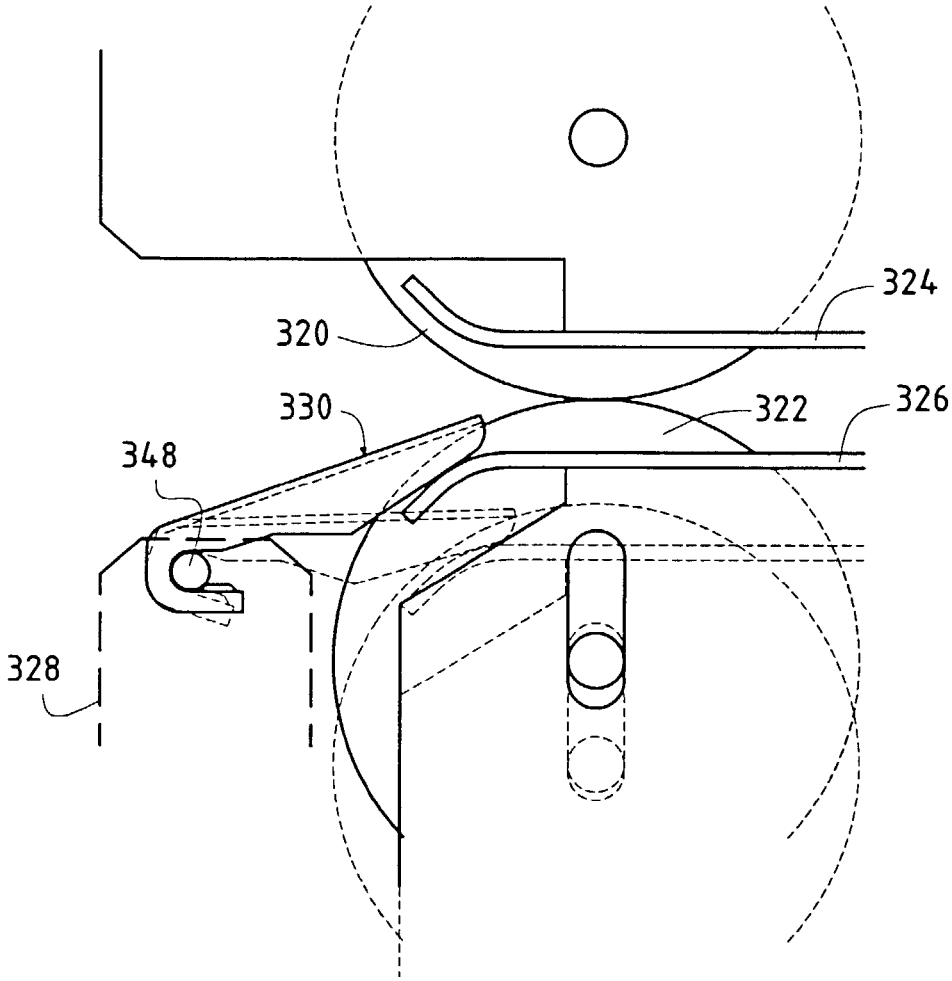
FIG. 1 is a longitudinal section through a preferred embodiment of a franking module of a mail-handling machine of the invention.
Figure 2:
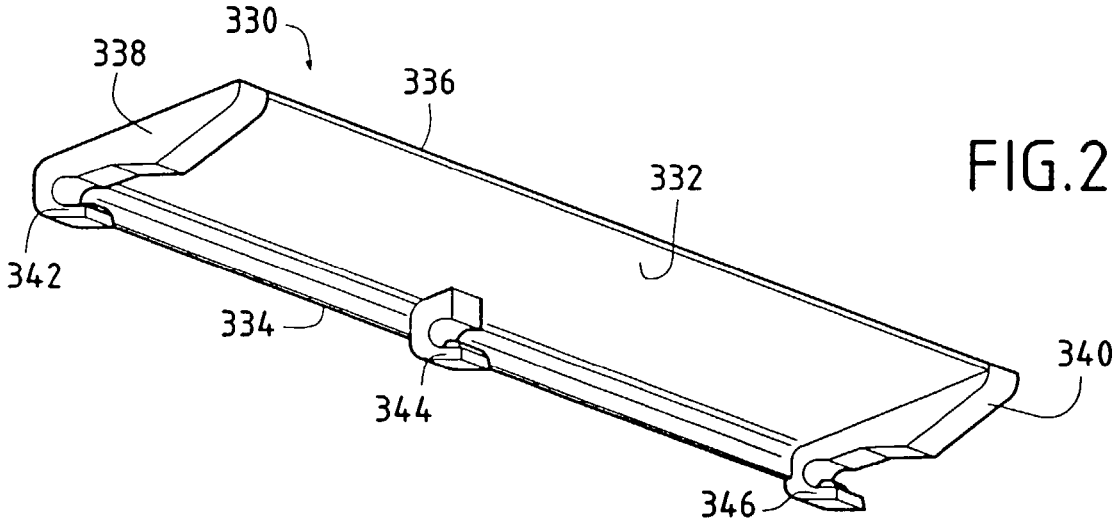
FIG. 2 shows a device for assisting the closure of envelope flaps in a franking module of FIG. 1.
Figure 3:
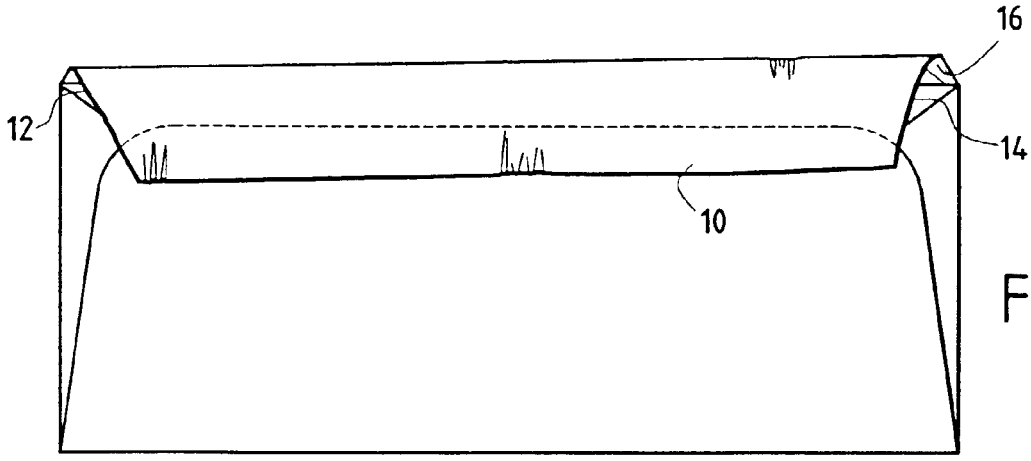
FIG. 3, shows an example of a defect observed when sealing envelopes using conventional machines.
Figure 4:
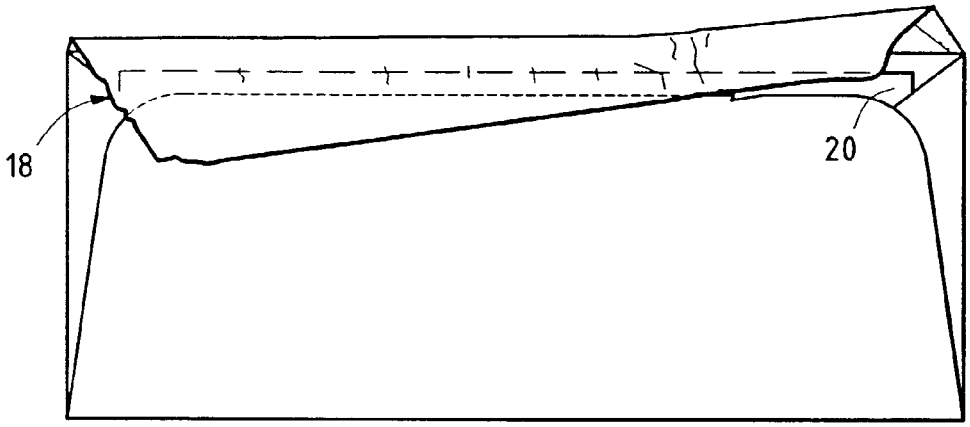
FIG. 4 shows another example of a defect observed when sealing envelopes using conventional machines.
Figure 5:
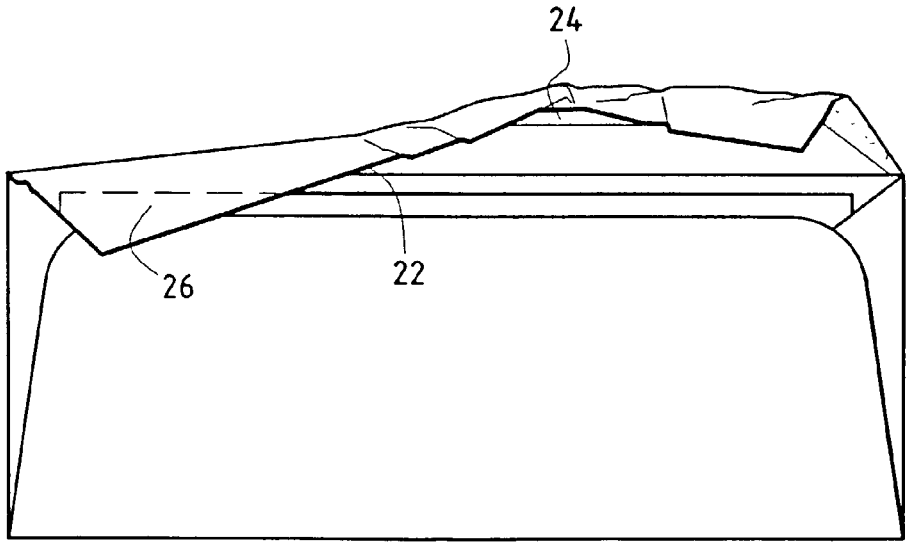
FIG. 5 shows yet another example of a defect observed when sealing envelopes using conventional machines.

A preferred embodiment of the invention is shown in FIG. 1 which is a fragmentary view of the franking module 32. At its inlet, this module is provided with two superposed engagement rollers 320, 322, and two guide plates, namely a bottom plate 326 and a top plate 324, which define between them a conveyor path for the mail items. In order to handle envelopes having different thicknesses, the bottom engagement roller 322 is mounted to move vertically in the body or base 328 of the franking module, and, as it moves, it entrains the bottom guide plate 326 of the conveyor path with it. The support means are constituted by a deflector 330 disposed transversely to the mail item conveyor path over a length substantially corresponding to the width of an envelope. This deflector (shown in FIG. 2) is in the form of a rectangular plate 332 curved over along one of its two longitudinal edges 334, 336, and it is provided with flanges 338, 340 on its two side edges. Clips 342, 344, 346, one at each side edge and at least one in a central position, are provided on the curved-over longitudinal edge 334 so as to fix onto a hinge pin 348 secured to or integral with the body of the franking module 328, thereby enabling the deflector to swing about said pin. The free longitudinal edge of the deflector 336 that is opposite from the hinge pin rests via the side flanges on the bottom guide plate 324 of the mail item conveyor path, so that the top surface of the deflector is substantially tangential to the peripheral surface of the bottom engagement roller 322.

Thus, the envelope is supported constantly as it is transferred between the feed module and the franking module, and the impacts are almost eliminated by means of the deflector lying tangentially relative to the engagement roller.

Naturally, the invention is not limited to the preferred embodiment described, and support means of different structure may be considered. In particular, the deflector may also be hinged via one of its longitudinal edges to a body of the feed module, its other longitudinal edge then resting on the bottom guide plate of the mail item conveyor path at the inlet of the franking module, so as to come substantially tangential to the peripheral face of the bottom engagement roller. In a variant, said other longitudinal edge may rest directly on the engagement means themselves (roller or belt). More precisely, such a moving deflector may be mounted on a front edge of the moistener device.

The invention claimed is:

1. A franking module for a mail-handling machine, said franking module comprising print means for printing a postage imprint on a mail item and conveyor means for conveying said mail item along a mail item conveyor path defined by top and bottom guide plates, which conveyor means comprise at least mail item engagement means including bottom means mounted to move vertically, which engagement means are disposed at the inlet of the franking module, said franking module further comprising support means disposed upstream of said mail item engagement means for supporting the mail items at the inlet of the franking module, which support means are suitable for being moved in a manner synchronized with the vertical movement of the bottom engagement means, wherein said support means are constituted by a deflector hinge via one of its longitudinal edges to a body or base of the franking module, the other of its two longitudinal edges resting on the bottom guide plate of the mail item conveyor path.

2. A franking module according to claim 1, wherein said deflector which is disposed transversely to the mail item conveyor path is clipped to a hinge pin on the body of the franking module.

* * * * *